US007507904B2

(12) United States Patent
Naas

(10) Patent No.: US 7,507,904 B2
(45) Date of Patent: Mar. 24, 2009

(54) ELECTRICAL CONDUCTOR

(75) Inventor: Nico Naas, Karlsruhe (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 10/494,576

(22) PCT Filed: Oct. 23, 2002

(86) PCT No.: PCT/EP02/11841

§ 371 (c)(1),
(2), (4) Date: Nov. 3, 2004

(87) PCT Pub. No.: WO03/036658

PCT Pub. Date: May 1, 2003

(65) Prior Publication Data

US 2005/0062037 A1 Mar. 24, 2005

(30) Foreign Application Priority Data

Oct. 23, 2001 (DE) ..... 101 52 166

(51) Int. Cl.
*H01B 7/00* (2006.01)

(52) U.S. Cl. ..... 174/36; 174/113 R

(58) Field of Classification Search ..... 174/113 R, 174/36, 117 F

See application file for complete search history.

(56) References Cited

U.S. PATENT DOCUMENTS

| | | | | |
|---|---|---|---|---|
| 4,374,299 A | | 2/1983 | Kincaid | 174/36 |
| 4,564,723 A | * | 1/1986 | Lang | 174/36 |
| 4,645,868 A | * | 2/1987 | Suzuki | 174/117 F |
| 4,926,007 A | | 5/1990 | Aufderheide et al. | 174/36 |
| 5,250,127 A | * | 10/1993 | Hara | 156/52 |
| 5,455,383 A | * | 10/1995 | Tanaka | 174/36 |
| 6,093,886 A | * | 7/2000 | Bazizi et al. | 174/31 R |
| 6,531,658 B2 | * | 3/2003 | Tanaka et al. | 174/117 F |
| 6,643,918 B2 | * | 11/2003 | Ortiz et al. | 29/825 |
| 2002/0074153 A1 | | 6/2002 | Uttinger et al. | 174/106 |

FOREIGN PATENT DOCUMENTS

| | | |
|---|---|---|
| DE | 1737860 | 1/1957 |
| DE | 2920031 | 12/1979 |

(Continued)

OTHER PUBLICATIONS

Japanese Patent Office.

*Primary Examiner*—Chau N Nguyen
(74) *Attorney, Agent, or Firm*—O'Shea Getz P.C.

(57) ABSTRACT

An electrical cable includes a first electrical conductor longitudinally surrounded by a first insulator, and a second electrical conductor that is substantially parallel to the first electrical conductor. The second electrical conductor is substantially longitudinally surrounded by a second insulator, and the second insulator includes a recess to partially expose the second electrical conductor. A metal layer longitudinally surrounds the first and second insulators. In another embodiment, an electrical cable includes a first electrical conductor and a second electrical conductor parallel to the first electrical conductor. An insulator longitudinally individually surrounds each of the first and second electrical conductors, and the insulator includes a radial recess through which the first electrical conductor is accessible. A metal layer longitudinally encapsulates the insulator and fills the recess such that the metal layer contacts the first electrical conductor through the recess.

17 Claims, 2 Drawing Sheets

FOREIGN PATENT DOCUMENTS

| | | | |
|---|---|---|---|
| DE | 69328404 | 5/1994 | |
| DE | 69421853 | 1/1995 | |
| DE | 19728940 | 1/1999 | |
| JP | 02131212 | 5/1990 | ..... 26/10 |
| JP | 05090738 | 4/1993 | ..... 3/18 |
| JP | 05342918 | 12/1993 | |
| JP | 10134640 | 5/1998 | |
| JP | 11120831 | 4/1999 | |
| WO | WO 00/74080 | 12/2000 | |

* cited by examiner

ELECTRICAL CONDUCTOR

BACKGROUND OF THE INVENTION

The present invention relates generally to electrical cables or lines, and in particular to an electrical cable/line that includes at least one insulated conductor.

In order to provide shielding from electromagnetic fields, electrical cables/lines are, for example, surrounded by a braid of electrically conductive material. The braid is fabricated, for example, from metal wire or threads composed of electrically conductive polymers. Both the process of actually fabricating such braids and the process of jacketing an electrical line or electrical cable with a braid of this type requires some effort which is reflected in high fabrication costs.

While lines and cables jacketed with a wire braid are in fact characterized by high flexibility, they do not possess the optimal shielding. Optimal shielding is achieved only by using a solid jacket, such as that found in a solid-jacket coaxial line, also called a semi-rigid coaxial line. In a solid-jacket coaxial line, the shielding outer line is made in a semi-rigid form, using copper tubing, for example.

The more flexible the implementation of a shielded line, the less impervious the conductor is to high frequency (HF) radiation. On the other hand, the more impervious a line is in its ability to provide shielding from electromagnetic fields, the less flexibility it possesses. Any improvement in one of these two parameters, flexibility and HF imperviousness, has typically resulted in a relatively large diminution of the other parameter.

What is needed is an electrical cable/line that combines both high flexibility with a high level of shielding.

SUMMARY OF THE INVENTION

An electrical cable includes a first electrical conductor longitudinally surrounded by a first insulator, and a second electrical conductor that is substantially parallel to the first electrical conductor. The second electrical conductor is substantially longitudinally surrounded by a second insulator, and the second insulator includes a recess to partially expose the second electrical conductor. A metal layer longitudinally surrounds the first and second insulators.

In another embodiment, an electrical cable includes a first electrical conductor and a second electrical conductor parallel to the first electrical conductor. An insulator longitudinally individually surrounds each of the first and second electrical conductors, and the insulator includes a radial recess through which the first electrical conductor is accessible. A metal layer longitudinally encapsulates the insulator and fills the recess such that the metal layer contacts the first electrical conductor through the recess.

An electrical cable or line includes at least one ground conductor that is partially surrounded by an insulator and exposed at one or more sites through the insulator. A metal layer is -vapor-deposited on the electrical line, and more specifically, the metal layer is vapor-deposited on the exposed sites of the ground conductor, such that the metal layer, which shields the electrical line, can be connected to the ground through a ground line.

The electrical line may include at least one insulated conductor on which, for example, electrical signals are transmitted for communications purposes, or on which an electrical current for the purpose of power transmission flows. The electrical line also includes a ground conductor partially surrounded by an insulator. The ground conductor is exposed through a region of the insulator at one or more sites. A metal layer is vapor-deposited on the line to provide electromagnetic shielding. Since the ground conductor is exposed at one or more sites, these sites are also provided with the vapor-deposited metal layer. Thus, each of these sites functions as a contact. When the ground conductor is grounded, the metal layer surrounding the electrical line is thus also grounded.

Because the shielding is achieved through a vapor-deposited metal layer, the electrical line is characterized both by high flexibility and by HF-impervious shielding. In addition, the vapor deposition of a metal layer onto the electrical line results in significantly lower cost than jacketing by a wire braid or a copper tube, with the result that the electrical line is characterized by high flexibility, HF-impervious shielding, and low fabrication costs. Such an electrical line is suitable, for example, for installation in vehicles.

These and other objects, features and advantages of the present invention will become more apparent in light of the following detailed description of preferred embodiments thereof, as illustrated in the accompanying drawings.

DETAILED DESCRIPTION OF THE INVENTION

Figure 2:
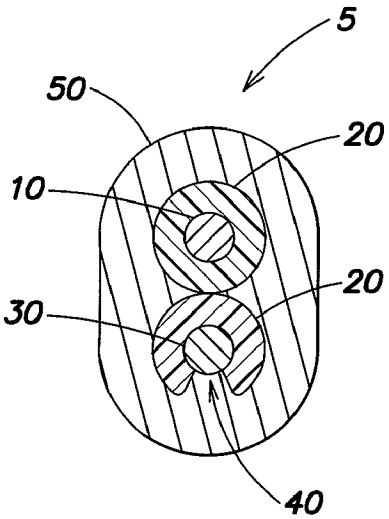
FIG. 2 is a cross section through the embodiment of FIG. 1.
Figure 1:
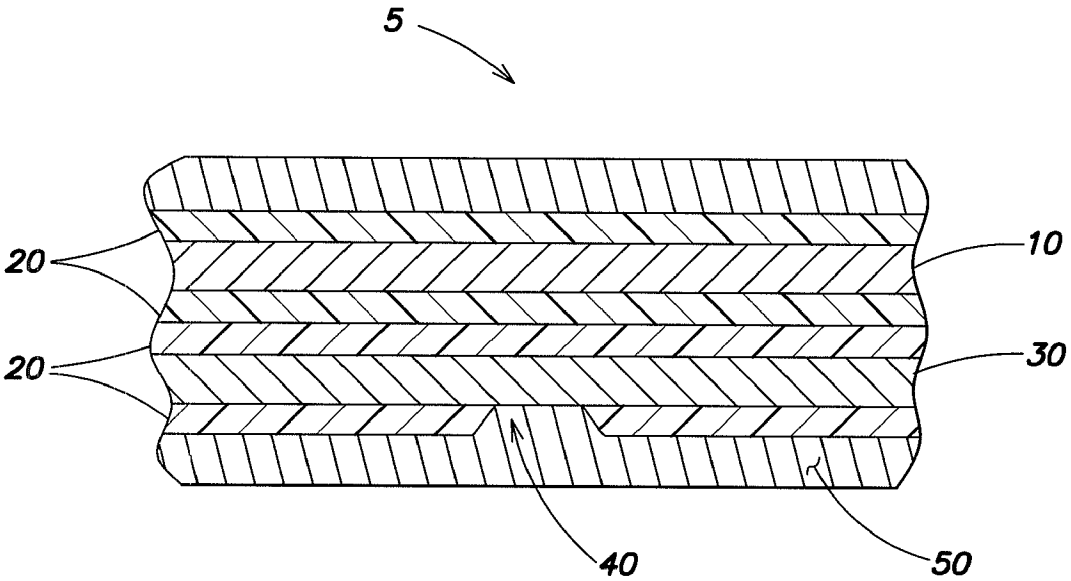
FIG. 1 is a lengthwise cross section through an embodiment of an electrical line in the form of a cable.

Referring to FIGS. 1 and 2, an electrical line 5, which is in the form of a cable, includes a conductor 10 for transmitting communications signals or power. The conductor 10 is surrounded by an insulation layer 20. A ground conductor 30 routed parallel to the conductor 10 is similarly surrounded by an insulation layer 20. The ground conductor 30 is exposed at a site 40. A metal layer 50 surrounds the line 5 and is vapor-deposited directly onto the ground conductor 30 at the site 40 such that the ground conductor 30 is electrically connected to the metal layer 50 that shields the line 5. By connecting the ground conductor 30 to ground, the line 5 is effectively shielded.

Figure 3:
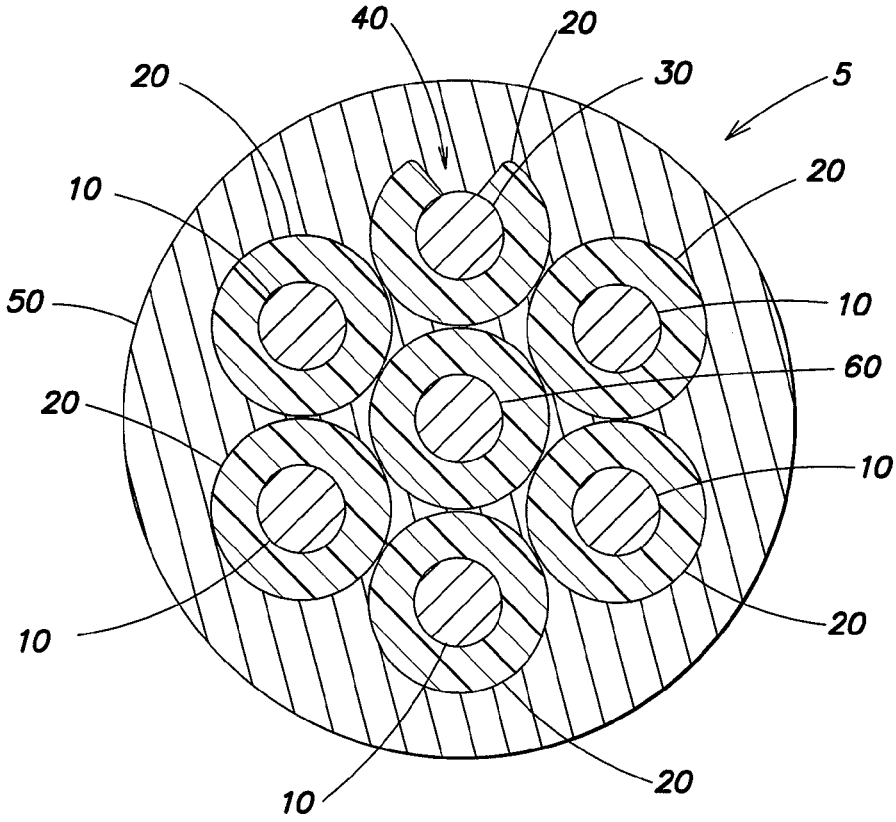
FIG. 3 is a cross section through an alternative embodiment of an electrical line in the form of a cable harness.
Figure 4:
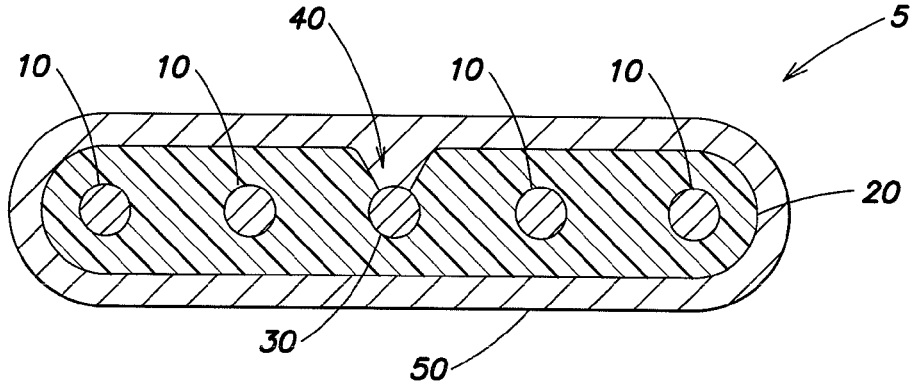
FIG. 4 is a cross section through another alternative embodiment of an electrical line in the form of a flat cable.

FIG. 3 illustrates an embodiment of the electrical line 5 configured as a cable harness. Multiple conductors 10 and a ground conductor 30 are arranged around a central conductor 60, the ground conductor 30 being exposed at a site 40. The conductors 10 are each surrounded by an associated insulation layer 20. The ground conductor 30 is partially surrounded by its associated insulation layer 20. The electrical line 5 illustrated in FIG. 3 is composed of conductors 10, 60, and 30 and a vapor-deposited metal layer 50 which is grounded. FIG. 4 is a cross section through an embodiment of a flat cable 5. Multiple conductors 10 as well as ground conductor 30 are embedded side by side within insulation layer 20. The ground conductor 30 is exposed at a site 40. A metal layer 50 is applied by vapor deposition to the surface of insulation layer 20, which metal layer 50 is vapor-deposited at exposed site 40 directly onto the ground conductor 30 which is grounded.

Although the present invention has been shown and described with respect to several preferred embodiments thereof, various changes, omissions and additions to the form and detail thereof, may be made therein, without departing from the spirit and scope of the invention.

What is claimed is:

1. An electrical line, comprising:

a first conductor co-axially surrounded by a first insulator;

a second conductor partially co-axially surrounded by a second insulator such that a portion of the second conductor is exposed, where the first and second insulators are separate from each other; and a vapor deposited metal layer that surrounds the first and second conductors, where the vapor deposited metal layer is in contact with the second conductor at the exposed portion thereof.

2. The electrical line of claim 1, where the vapor deposited metal layer is applied by vapor deposition onto a cable harness that includes the second conductor.

3. The electrical line of claim 1, where the vapor deposited metal layer is applied by vapor deposition onto a flat cable that includes the second conductor.

4. The electrical line of claim 1, where the vapor deposited metal layer is applied by vapor deposition onto a flex line that includes the second conductor.

5. The electrical line of claim 1, where the electrical line is intended for installation in a motor vehicle.

6. An electrical cable, comprising:

a first electrical conductor longitudinally co-axially surrounded by a first insulator;

a second electrical conductor that is substantially parallel to the first electrical conductor, where the second electrical conductor is substantially longitudinally co-axially surrounded by a second insulator, where the second insulator includes a recess to partially expose the second electrical conductor, where the first and second insulators are separate from each other; and a vapor deposited metal layer that longitudinally surrounds the first and second insulators and fills the recess where the vapor deposited metal layer is in electrical contact with the second electrical conductor.

7. The electrical cable of claim 6, where the vapor deposited metal layer comprises a vapor-deposited metal layer.

8. The electrical cable of claim 7, where the second electrical conductor is configured and arranged as an electrical ground conductor.

9. The electrical cable of claim 6, where the vapor deposited metal layer is connected to a fixed reference potential.

10. The electrical cable of claim 9, where the fixed reference potential is electrical ground.

11. The electrical cable of claim 6, where the first and second insulators are radially in contact.

12. The electrical cable of claim 6, where the second electrical conductor and a plurality of insulated conductors are arranged planetarely with respect to the first electrical conductor, and the vapor deposited metal layer radially encapsulates the second electrical conductor and the plurality of insulated conductors.

13. An electrical cable, comprising:

a first electrical conductor at least partially co-axially surrounded by a first insulator;

a second electrical conductor adjacent to the first electrical conductor and co-axially surrounded by a second insulator, where the first and second insulators are separate from each other, where the first insulator includes a radial recess through which the first electrical conductor is accessible; and a vapor deposited metal layer that encapsulates the first insulator and fills the recess such that the vapor deposited metal layer contacts the first electrical conductor through the recess.

14. The electrical cable of claim 13, where the first electrical conductor is configured and arranged as a ground conductor.

15. The electrical cable of claim 13, further comprising a third electrical conductor adjacent to the first and second electrical conductors, where a third insulator co-axially surrounds the third electrical conductor, and where the second electrical conductor is located between the first and third conductors.

16. The electrical cable of claim 15, where the vapor deposited metal layer is connected to a fixed reference potential.

17. The electrical cable of claim 16, where the fixed reference potential is electrical ground.

* * * * *